US010907793B1

(12) United States Patent
Hong

(10) Patent No.: US 10,907,793 B1
(45) Date of Patent: Feb. 2, 2021

(54) VEHICLE LAMP WITH ROTATING LIGHT SOURCE WHERE THE LIGHT SOURCES ARE ROTATED BASED ON SENSED IMAGE

(71) Applicants: Hyundai Motor Company, Seoul (KR); Kia Motors Corporation, Seoul (KR)

(72) Inventor: Seung-Pyo Hong, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/853,223

(22) Filed: Apr. 20, 2020

(30) Foreign Application Priority Data

Dec. 13, 2019 (KR) ..... 10-2019-0167158

(51) Int. Cl.

| | |
|---|---|
| ***F21S 45/43*** | (2018.01) |
| ***F21S 41/151*** | (2018.01) |
| ***F21S 41/657*** | (2018.01) |
| ***F21S 41/663*** | (2018.01) |
| ***F21S 41/30*** | (2018.01) |
| ***F21S 41/19*** | (2018.01) |

(52) U.S. Cl.
CPC ..... *F21S 45/43* (2018.01); *F21S 41/151* (2018.01); *F21S 41/19* (2018.01); *F21S 41/30* (2018.01); *F21S 41/657* (2018.01); *F21S 41/663* (2018.01)

(58) Field of Classification Search
CPC ..... F21S 41/141; F21Y 2115/10; B60Q 2300/41; B60Q 2300/42; B60Q 2300/43; B60Q 2300/45; B60Q 2300/47
See application file for complete search history.

(56) References Cited

U.S. PATENT DOCUMENTS

| | | | | |
|---|---|---|---|---|
| 10,184,634 | B2 | 1/2019 | Shim | |
| 10,215,357 | B2 * | 2/2019 | Watanabe | B60Q 1/0058 |
| 10,493,898 | B2 * | 12/2019 | Kurebayashi | B60Q 1/085 |
| 2018/0106453 | A1 | 4/2018 | Shim | |

FOREIGN PATENT DOCUMENTS

KR 2018-0043038 A 4/2018

* cited by examiner

*Primary Examiner* — Robert J May
(74) *Attorney, Agent, or Firm* — Mintz Levin Cohn Ferris Glovsky and Popeo, P.C.; Peter F. Corless

(57) ABSTRACT

A vehicle lamp with a rotating light source is provided. The lamp includes a signal transmitter that receives a signal from one or more sensors provided in a vehicle and an LED unit having one or more LED elements for irradiating light to the outside of the vehicle. A controller receives the signal from the signal transmitter. A power transmitter and a power receiver receive an applied voltage to be applied to the one or more LED elements from the controller, and apply the applied voltage to each of the one or more LED elements, and a driver that rotates the LED unit. The controller determines an image shape according to the signal, and calculates the applied voltage to be applied to the one or more LED elements according to the computed image shape.

11 Claims, 15 Drawing Sheets

VEHICLE LAMP WITH ROTATING LIGHT SOURCE WHERE THE LIGHT SOURCES ARE ROTATED BASED ON SENSED IMAGE

CROSS-REFERENCE TO RELATED APPLICATION

This application claims priority to Korean Patent Application No. 10-2019-0167158, filed on Dec. 13, 2019, which is incorporated herein by reference in its entirety.

BACKGROUND

Field of the Disclosure

The present disclosure relates to a vehicle lamp with a rotating light source, and more particularly, to a vehicle lamp with a rotating light source in which the number of light emitting diodes (LEDs) provided is reduced and heat dissipation performance is improved.

Description of Related Art

A matrix headlamp technology is currently applied to a vehicle headlamp. To implement the matrix headlamp technology, one or more LED elements are concentrated in the headlamp. By controlling the light emission of each LED element, only the light expected to reach the driver of the oncoming vehicle during high lamp operation may be removed or turned off. By locating a liquid-crystal display (LCD) screen on the front surface of one or more LED elements, and changing the transparency of the LCD screen to a specific shape, a technology of forming a specific type of light on the front surface of the vehicle is also being developed.

To implement the matrix headlamp technology, a circuit for independently controlling each LED element is required. In addition, a substantial number of large and small LED elements, such as a micro LED and pixel lighting, are required. However, the LED element generates heat during light emission. When an increased number of large and small LED elements are concentrated on a printed circuit board (PCB), the generated heat is excessive, thereby reducing the heat resistance performance of the PCB and the LED element. In particular, since an interval between the LED elements is minimized but the LED elements may not overlap, the emitted light inevitably has a boundary line.

The contents described in this section are merely to help the understanding of the background of the present disclosure, and may include what is not previously known to those skilled in the art to which the present disclosure pertains.

SUMMARY

Accordingly, an object of the present disclosure considering the above point is to provide a vehicle lamp with a rotating light source, which may improve heat resistance performance as the number of LED elements is reduced, and generating surface emission having no boundary line.

To achieve the object, a vehicle lamp with a rotating light source according to the present disclosure may include a signal transmitter configured to receive a signal from one or more sensors mounted within a vehicle, an LED unit provided with one or more LED elements configured to irradiate light to the outside of the vehicle, a controller configured to receive the signal from the signal transmitter, a power transmitter and a power receiver configured to receive an applied voltage to be applied to the one or more LED elements from the controller, and apply the applied voltage to each of the one or more LED elements, and a driver configured to rotate the LED unit. The controller may be configured to determine an image shape according to the signal, and calculate the applied voltage to be applied to the one or more LED elements according to the determined image shape.

In addition, the LED unit may be fixed to a rotary shaft that protrudes from the driver to the outside of the vehicle, the power receiver may be mounted to the LED unit to be electrically connected to the one or more LED elements, and the power transmitter, the controller, and the signal transmitter may be located and fixed to one side of the driver. The signal may include any one or more of an angle of a front vehicle, a front image of the vehicle, and a rear image of the vehicle from the center line of the front and rear of the vehicle, the signal transmitter may be configured to receive a lamp AUTO switch operation signal, an upward lighting operation signal, and a revolutions per minute (RPM) of the driver, in addition to the signal, and the controller may be configured to select any one of one or more image shapes stored based on various signals received from the signal transmitter.

In addition, the applied voltage may be applied to the one or more LED elements from the power transmitter through a slip ring or a gear disposed between the power transmitter and the power receiver. The applied voltage may be applied to the one or more LED elements from the power transmitter by electromagnetic induction generated between the power transmitter and the power receiver, when the LED unit rotates.

The power transmitter and the power receiver may include a PCB, and the PCB may include two or more pattern surfaces on which a circuit pattern is printed, and an insulating filler disposed between the two or more pattern surfaces, and the circuit patterns printed on the two or more pattern surfaces may be connected to form a coil shape. The circuit pattern may include a first side end portion that protrudes from the lower portion of the pattern surface, a second side end portion that protrudes from the upper portion of the pattern surface, and a center portion that connects the first side end portion and the second side end portion and located on the pattern surface as a ring shape.

In addition, the vehicle lamp with the rotating light source may further include an optical system disposed on the front surface of the LED unit, and for inducing light generated by the one or more LED elements to a specific direction. The vehicle lamp with the rotating light source may further include a reflector and a shield disposed on the front surface of the LED unit, and for inducing light generated by the one or more LED elements to a specific direction.

To achieve the object, a vehicle lamp with a rotating light source according to the present disclosure may include a signal transmitter configured to receive a signal from one or more sensors provided in a vehicle, an LED unit having one or more LED elements configured to irradiate light to the outside of the vehicle, a controller configured to receive the signal from the signal transmitter, a power transmitter and a power receiver configured to receive an applied voltage to be applied to the one or more LED elements from the controller, and apply the applied voltage to each of the one or more LED elements, a driving guider to which the LED unit may be fixed, and a driver configured to move the driving guider, and the controller may be configured to determine an image shape according to the signal, and calculate the applied voltage to be applied to the one or more LED elements according to the computed image shape.

The driving guider may include a rail having an end portion fixed to a rotary shaft that protrudes from the driver to the outside of the vehicle, the one or more LED elements may be fixed to the rail to be listed, the power receiver may be mounted to the rail to be electrically connected to the one or more LED elements. The power transmitter may be formed along the trajectory of the rail generated when the rotary shaft rotates.

When the rotary shaft rotates, the applied voltage may be applied to the one or more LED elements from the power transmitter by the contact between the power receiver and the power transmitter. In addition, when the rotary shaft rotates, the applied voltage may be applied to the one or more LED elements from the power receiver by electromagnetic induction generated between the power receiver and the power transmitter.

According to the vehicle lamp with the rotating light source according to an exemplary embodiment of the present disclosure configured as described above, it may be possible to improve the heat resistance performance of the PCB and the LED elements as the number of LED elements is reduced. In addition, since the LED element rotates and emits light, the residual image may be generated along the rotating path of the LED element, and infinite LED elements emit light simultaneously. Ultimately, it may be possible to generate the surface emission having no boundary line. Further, one or more rotating plates may be disposed in the LED unit, and the one or more rotating plates may have different distances from the driver, thereby implementing the three-dimensional light source.

BRIEF DESCRIPTION OF THE DRAWINGS

The above and other features of the present disclosure will now be described in detail with reference to certain exemplary embodiments thereof illustrated in the accompanying drawings which are given hereinbelow by way of illustration only, and thus are not limitative of the present invention, and wherein.

DETAILED DESCRIPTION

Figure 1:
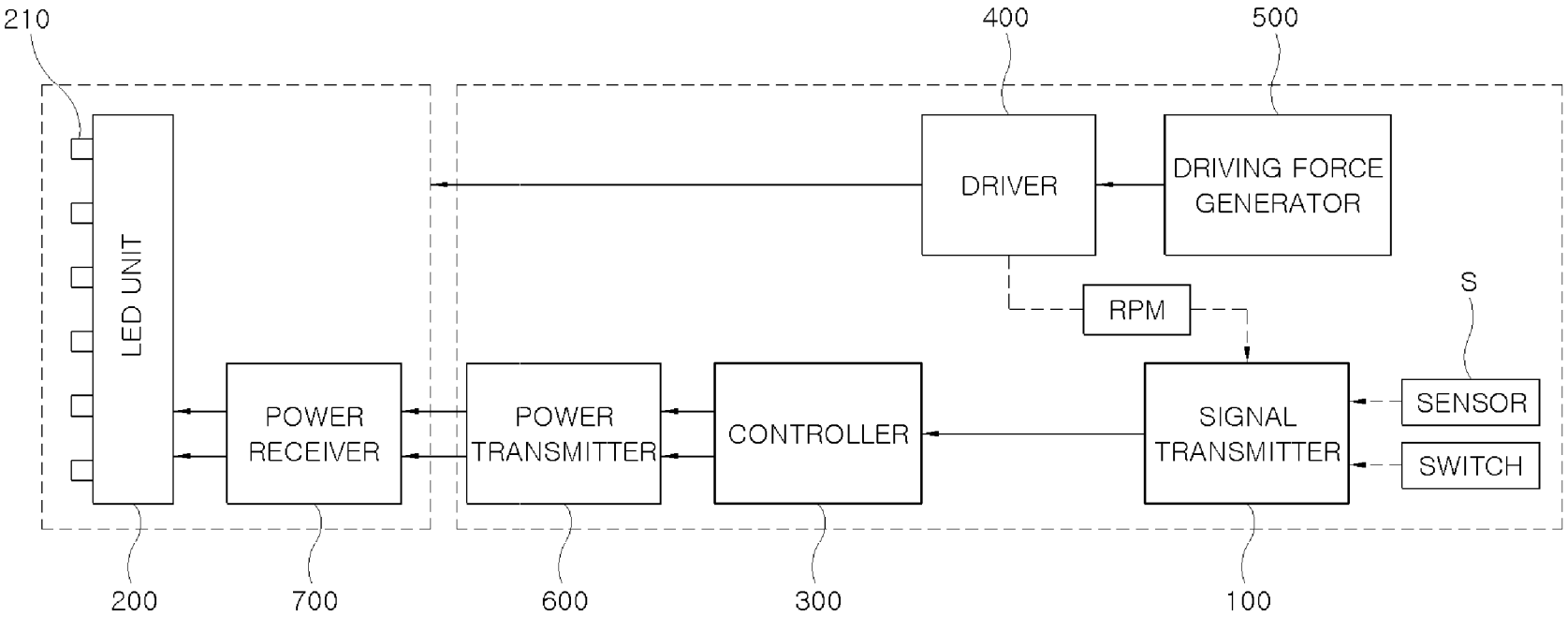
FIG. 1 is a block diagram showing a vehicle lamp with a rotating light source according to a first exemplary embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

Furthermore, control logic of the present disclosure may be embodied as non-transitory computer readable media on a computer readable medium containing executable program instructions executed by a processor, controller/control unit or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinafter, a vehicle lamp with a rotating light source according to an exemplary embodiment of the present disclosure will be described with reference to the accompanying drawings.

Figure 2:
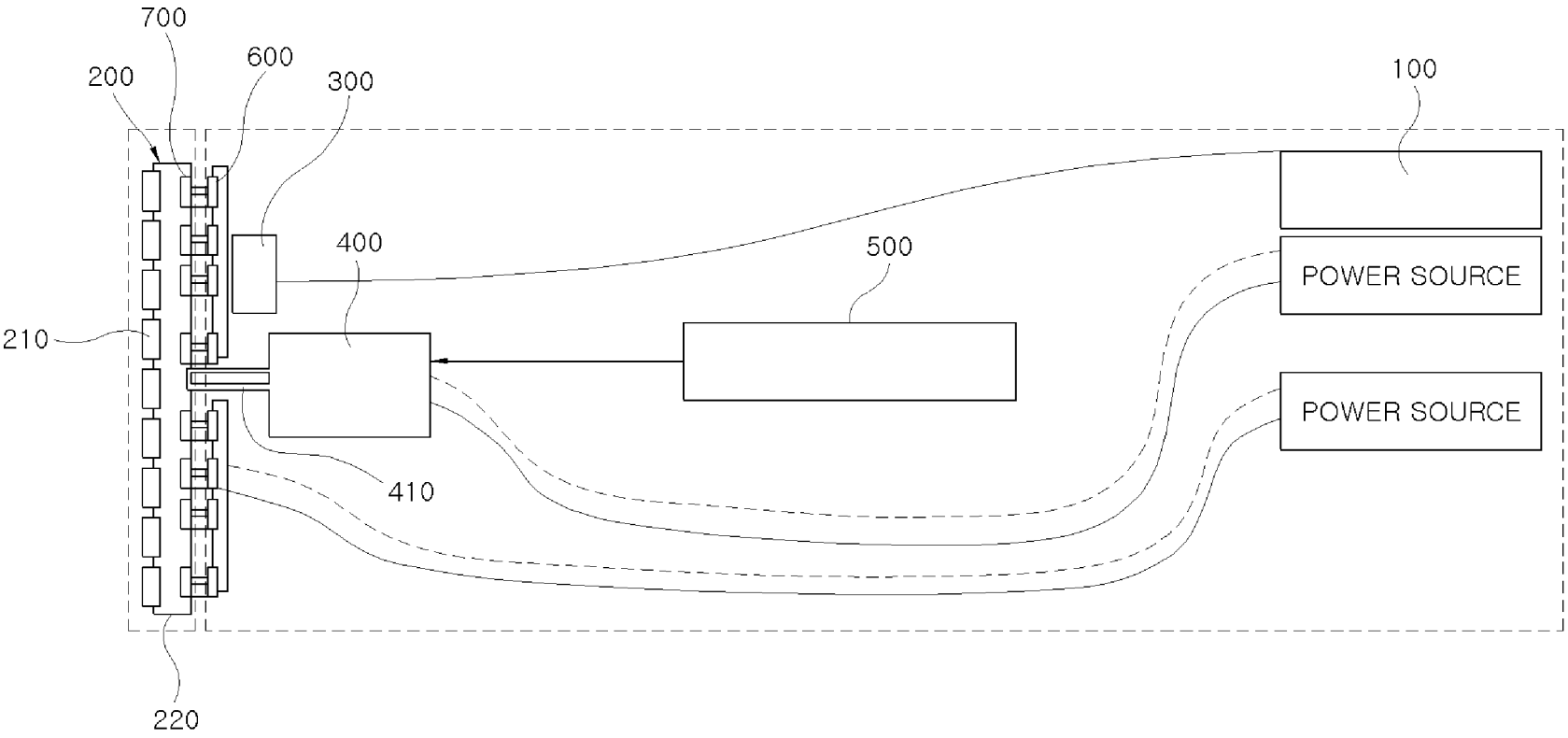
FIGS. 2 and 3 are exemplary diagrams showing the vehicle lamp with the rotating light source according to the first exemplary embodiment of the present disclosure of FIG. 1.
Figure 3:
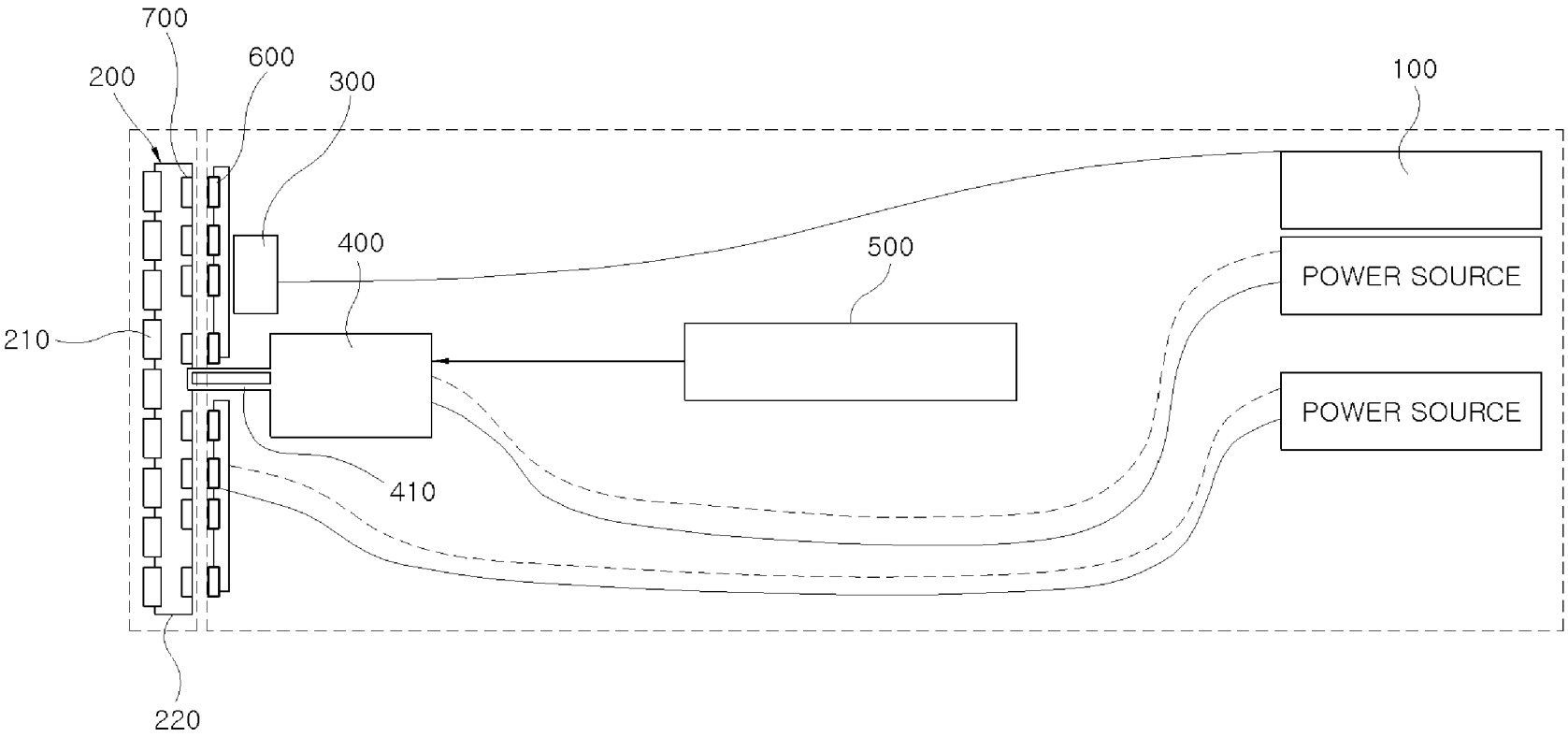

As shown in FIGS. 1 to 3, a vehicle lamp with a rotating light source according to a first exemplary embodiment of the present disclosure may include a signal transmitter 100 configured to receive a signal from one or more sensors (S) mounted within a vehicle, an LED unit 200 having one or more LED elements 210 configured to irradiate light to the outside of the vehicle, a controller 300 configured to receive a signal from the signal transmitter 100, a power transmitter 600 and a power receiver 700 configured to receive an applied voltage to be applied to one or more LED elements 210 from the controller 300, and apply the applied voltage to each of the one or more LED elements 210, and a driver 400 configured to rotate the LED unit 200. The controller 300 may be configured to determine an image shape according to the signal, and calculate the applied voltage to be applied to one or more LED elements 210 according to the computed image shape.

According to an example, the LED unit 200 may be fixed to a rotary shaft 410 that protrudes from the driver 400 to the outside of the vehicle. The power receiver 700 may be mounted to the LED unit 200 to be electrically connected to one or more LED elements 210. The power transmitter 600, the controller 300, and the signal transmitter 100 may be disposed and fixed to one side of the driver 400.

The signal transmitter 100 may be configured to transmit a signal including any one or more of an angle of the front vehicle, a front image of the vehicle, and a rear image of the vehicle from the center line of the front and rear of the vehicle to the controller 300. In addition to the signal, the signal transmitter 100 may be configured to receive a lamp AUTO switch operation signal, an upward lighting operation signal, and an RPM of the driver 400, and transmit the received signals to the controller 300. The signal transmitter 100 may then be configured to transmit the signal to the controller 300 using pulse width modulation (PWM) or controller area network (CAN) communication.

As another exemplary embodiment, the signal transmitter 100 may be configured to stop transmission of a signal to the controller 300, select any one of one or more operation patterns stored according to various signals, and transmit the selected operation pattern to the controller 300 using PWM or CAN communication. Meanwhile, the controller 300 may be configured to select any one of one or more image shapes stored based on various signals received from the signal transmitter 100. When a lamp on signal is applied, the controller 300 may be configured to adjust the rotation angle of the LED unit 200 to be a reference state.

According to an example, the controller 300 may be configured to measure a time or an RPM adjusted to thus adjust the rotation angle of the LED unit 200 to become the reference state, and select the measured time or RPM as one cycle. The controller 300 may be configured to derive the operation pattern of the one or more LED elements 210 which may implement the selected image shape for each cycle, and calculate the magnitude of the applied voltage applied to the one or more LED elements 210 for each cycle so that the operation pattern may be implemented.

The vehicle lamp with the rotating light source according to an exemplary embodiment of the present disclosure may be configured to continuously control the On, Off, and light generation amount of one or more LED elements 210 so that an operation pattern may be implemented. The operation pattern may include a turn-on position or a turn-off position based on the rotation angle and the RPM of the rotating plate 220. When the turn-on position is included in the operation pattern, the LED element 210 may be turned on at the turn-on position, and may be turned off when it is not the turn-on position. When the turn-off position is included in the operation pattern (P), the LED element 210 may be turned off at the turn-off position and may be turned on when it is not the turn-off position.

The controller 300 may be configured to transmit the calculated applied voltage for each cycle to the power transmitter. The power transmitter may be configured to apply an applied voltage to the power receiver based on the received applied voltage for each cycle, and the power receiver may be configured to apply the applied voltage to each of the one or more LED elements 210. Accordingly, the image shape selected by the controller 300 may be implemented outside the vehicle by the light irradiated to the front of the LED unit 200.

Figure 4:
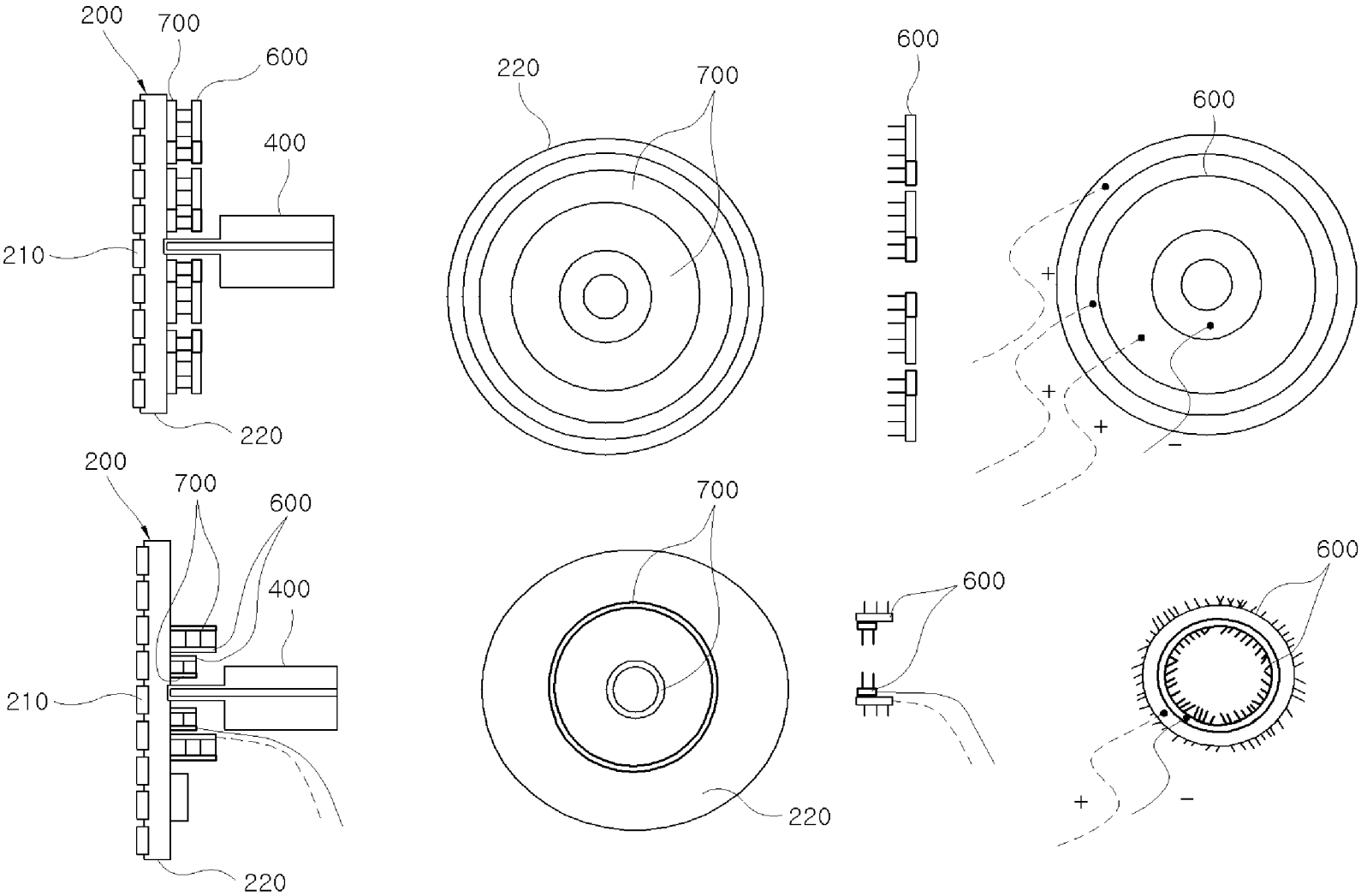
FIGS. 4 to 7 are exemplary diagrams showing a power transmitter and a power receiver provided in the vehicle lamp with the rotating light source according to the first exemplary embodiment of the present disclosure of FIG. 1.
Figure 5:
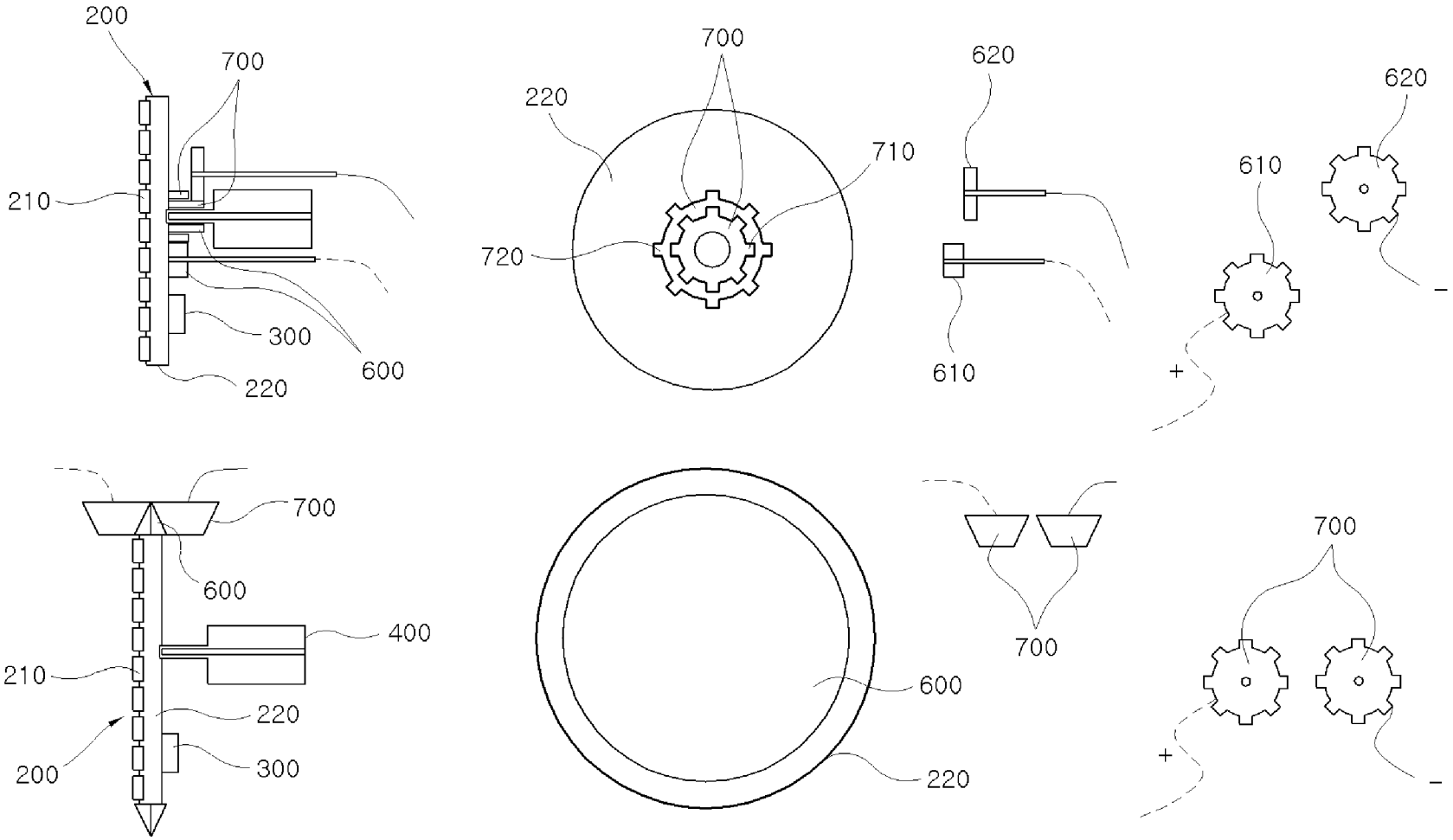

As shown in FIG. 2, the power transmitter and the power receiver may be electrically connected via a slip ring or a gear. As shown in FIGS. 4 and 5, the power transmitter and the power receiver may be electrically connected via the slip ring or the gear.

As shown in FIGS. 2 and 4, the power transmitter 600 may be formed of a brush wire behind the LED unit 200, and the power receiver 700 may be formed of a slip ring behind the LED unit 200 to contact the brush wire. The slip ring may be formed in a disc or tube shape. The brush wire may be formed parallel to or perpendicular to the rotary shaft 410, according to the shape of the slip ring.

As shown in FIGS. 2 and 5, the power transmitter 600 may include a +transmission gear 610 and a −transmission gear 620 disposed behind or above the LED unit 200, and the power receiver 700 may also include a +reception gear 710 located behind or beside (e.g., proximate to) the LED unit 200 to be engaged with the +transmission gear 610, and a −reception gear 720 disposed behind or beside (e.g., proximate to) the LED unit 200 to be engaged with the −transmission gear 620.

Figure 6:
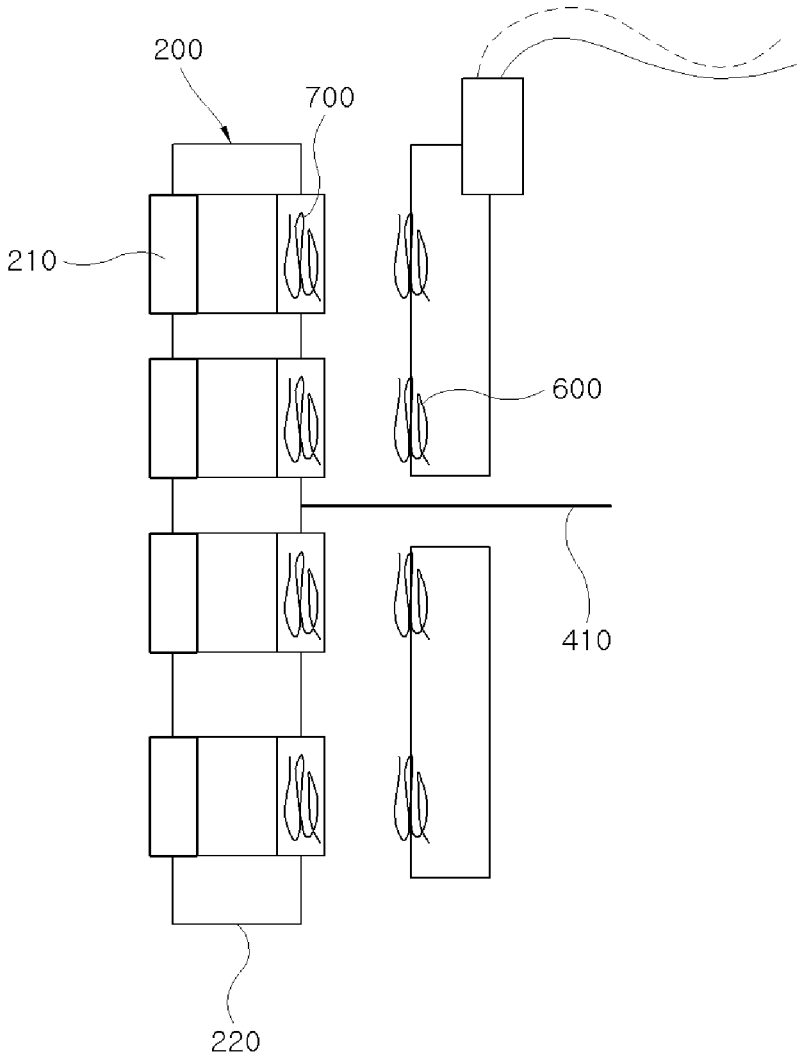
Figure 7:
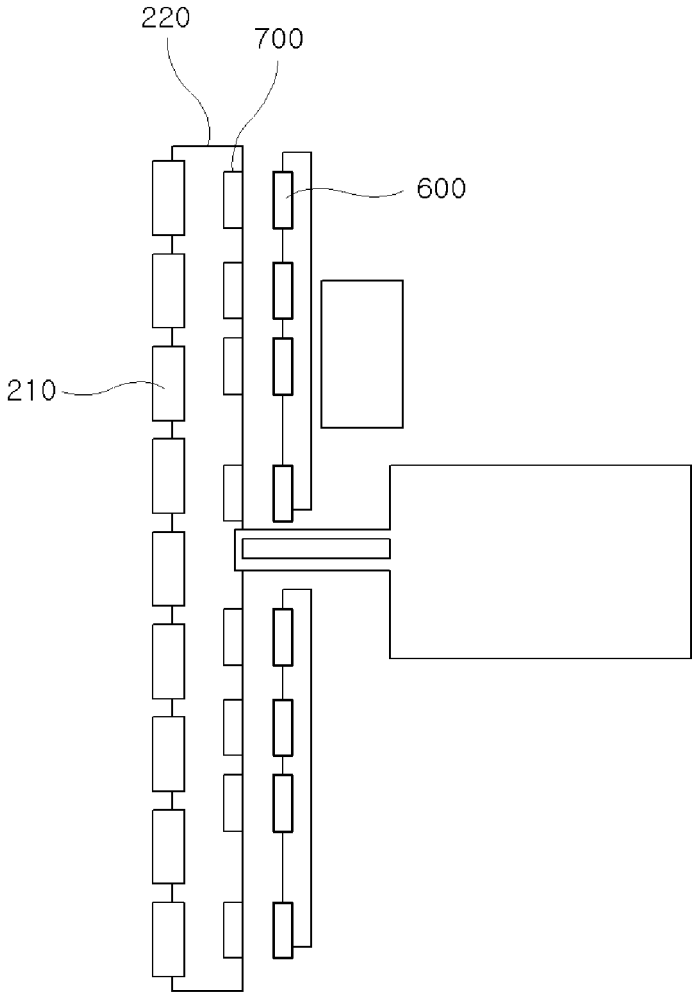

As another example, as shown in FIGS. 6 and 7, the power transmitter and the power receiver may be electrically connected by electromagnetic induction. As shown in FIGS. 3 and 6, the power transmitter 600 may be formed of an electromagnet located behind the LED unit 200, and the power receiver 700 may be formed of a coil on the rear surface of the LED unit 200 to face the electromagnet.

Figure 8:
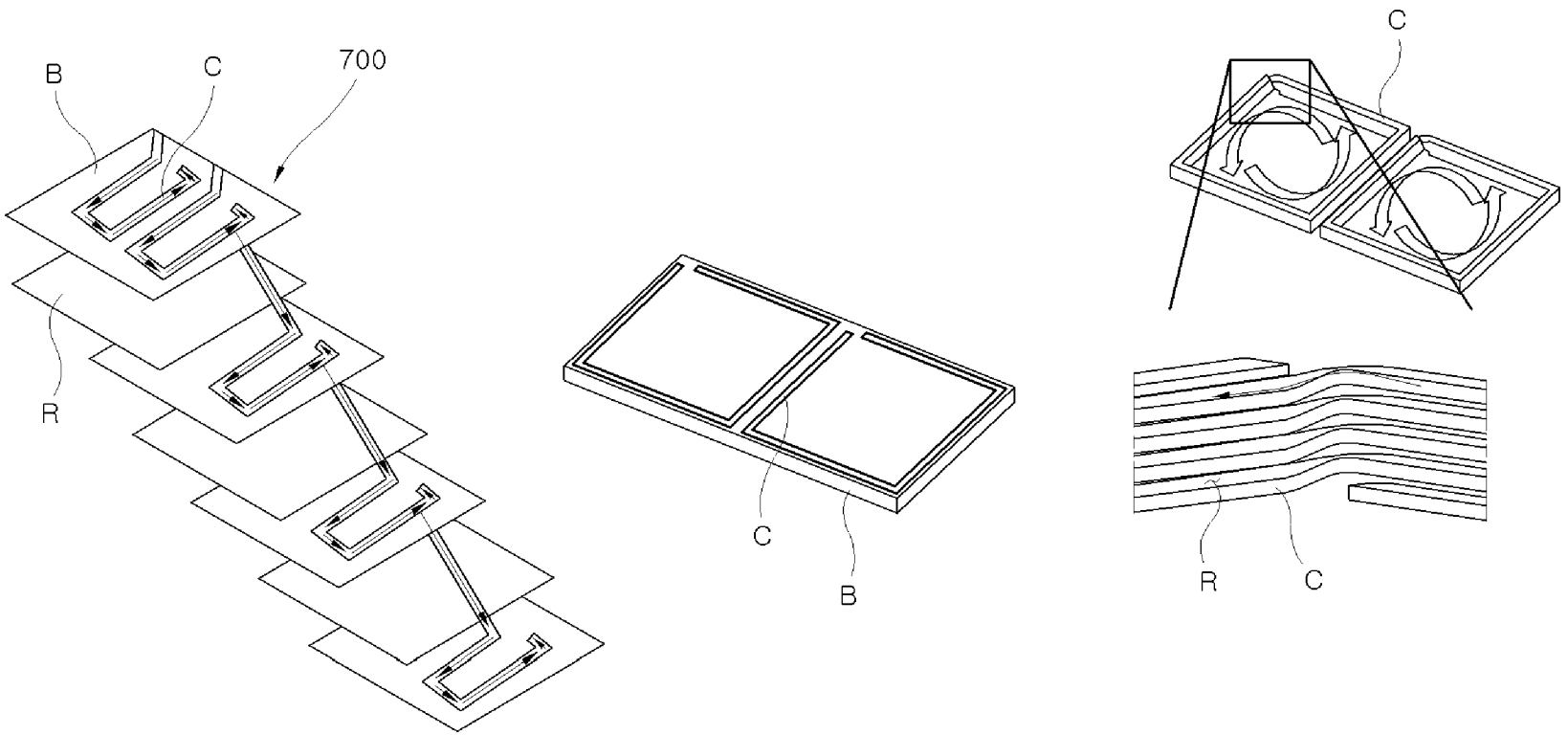
FIG. 8 is an exemplary diagram showing a PCB provided on the power transmitter and the power receiver of FIG. 7 according to the first exemplary embodiment of the present disclosure.

As shown in FIGS. 3 and 7, the power transmitter 600 may be formed of an electromagnet located behind the LED unit 200, and the power receiver 700 may be formed of a PCB including a coil facing the electromagnet. As shown in FIG. 8, the PCB may include two or more pattern surfaces (B) on which a circuit pattern (C) is printed, and an insulating filler (R) disposed between the two or more pattern surfaces (B). The circuit patterns (C) printed on two or more pattern surfaces (B) may be connected to form the coil shape.

The circuit pattern (C) may include a first side end portion that protrudes from the lower portion of the pattern surface (B), a second side end portion that protrudes from the upper portion of the pattern surface (B), and the center portion connecting the first side end portion to the second side end portion and disposed on the pattern surface (B) as a ring shape. Two or more circuit patterns (C) may be formed on the pattern surface (B) at equal intervals.

Meanwhile, the driver 400 may be configured to receive power from a driving force generator 500. The driving force generator 500 may be configured to select a driving level according to various signals received from the controller 300 or the signal transmitter 100, and apply the selected driving level to the driver 400. The driver 400 may be configured to the rotary shaft 410 according to the driving level to change the RPM of the LED unit 200. Additionally, the driver 400 may be configured to transmit the RPM of the rotary shaft 410 to the signal transmitter 100.

According to an example, the driving force generator 500 may be configured to receive external power, and apply a voltage adjusted according to the driving level to the driver 400 provided as a motor. In particular, the driving force generator 500 may be configured to adjust a PWM duty ratio using an element such as an intelligent power switch to apply a constant voltage to the driver 400. According to another example, the driving force generator 500 may include an computation unit configured to select a driving level, and an operation unit configured to generate a rotational force according to the driving level, or receive the rotational force from the engine, and change the rotational force to a specific RPM (not shown, for example, a gear assembly connected to the motor, a gear assembly connected to an engine). In particular, the driver 400 may be configured to receive the rotational force as a driving level from the operation unit and rotate at a specific RPM.

Figure 9:
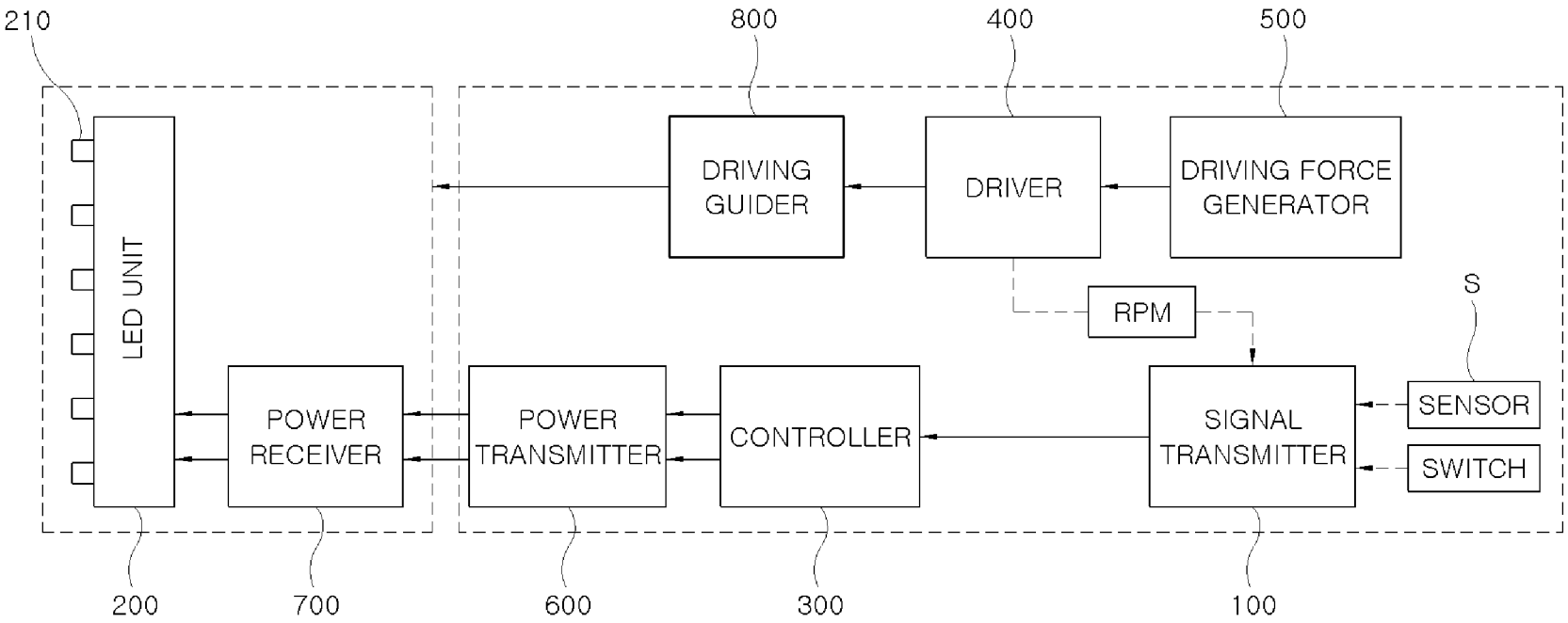
FIG. 9 is a block diagram showing a vehicle lamp with a rotating light source according to a second exemplary embodiment of the present disclosure.
Figure 10:
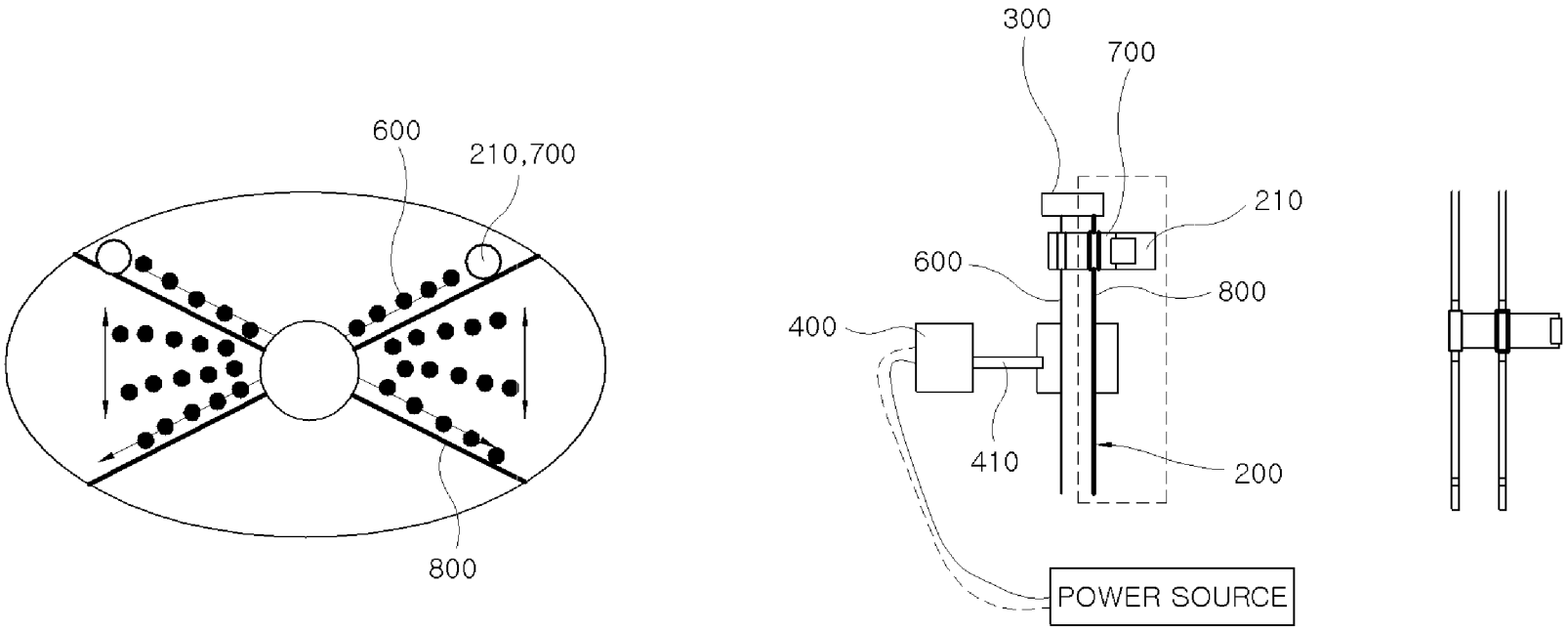
FIGS. 10 and 11 are exemplary diagrams showing the vehicle lamp with the rotating light source according to the second exemplary embodiment of the present disclosure of FIG. 9.
Figure 11:
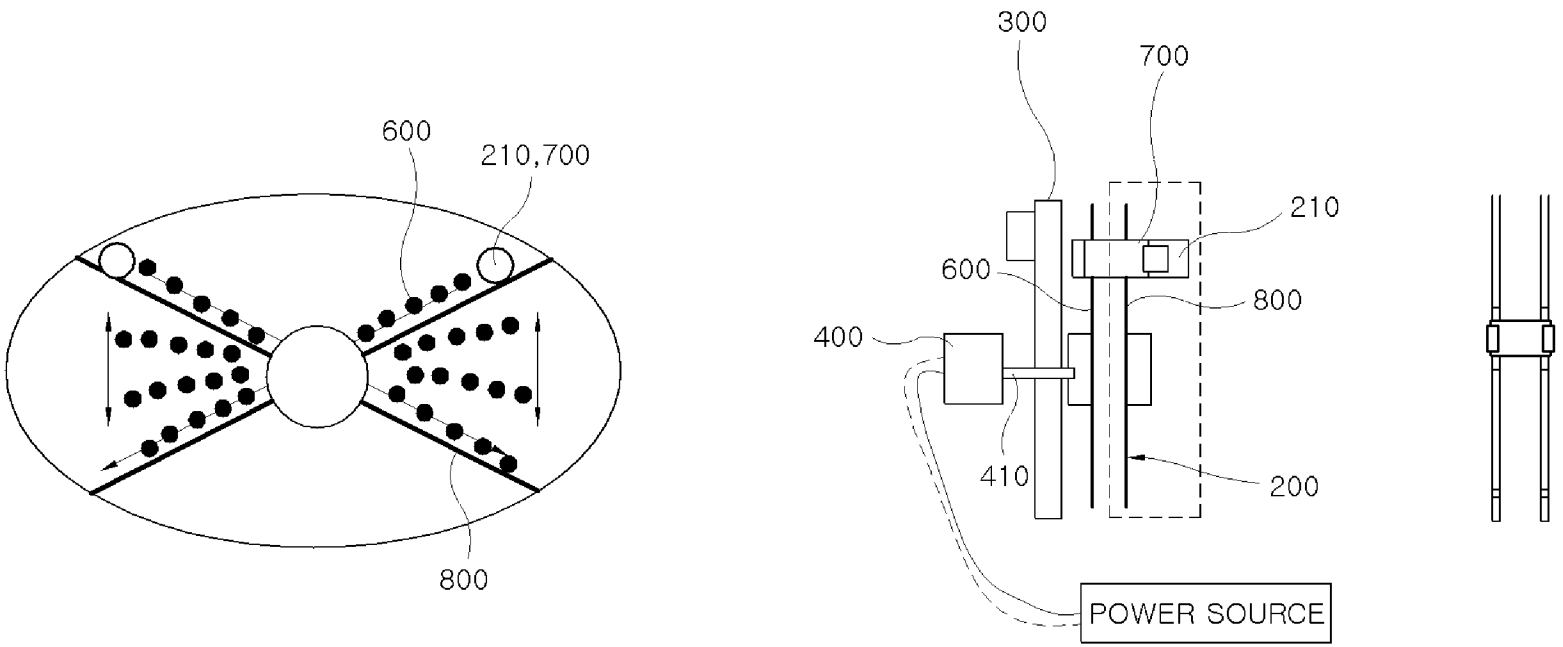

As shown in FIGS. 9 to 11, a vehicle lamp with a rotating light source according to a second exemplary embodiment of the present disclosure may include the signal transmitter 100 configured to receive a signal from one or more sensors (S) mounted within the vehicle, the LED unit 200 having one or more LED elements 210 configured to irradiate light to the outside of the vehicle, the controller 300 configured to receive a signal from the signal transmitter 100, the power transmitter 600 and the power receiver 700 configured to receive the applied voltage to be applied to the one or more LED elements 210 from the controller 300, and apply the applied voltage to each of the one or more LED elements 210, a driving guider 800 to which the LED unit 200 is fixed, and the driver 400 configured to move the driving guider 800. The controller 300 may be configured to determine an image shape according to the signal, and calculate the applied voltage to be applied to one or more LED elements 210 according to the determined image shape.

As described above, the signal transmitter 100 may be configured to transmit a signal including an angle of the front vehicle, a front image of the vehicle, and a rear image of the vehicle to the controller 300. In addition to the signal, the signal transmitter 100 may be configured to receive a lamp AUTO switch operation signal, an upward lighting operation signal, and an RPM of the driver 400, and transmit the received signal to the controller 300. The signal transmitter 100 may then be configured to transmit the signal to the controller 300 using PWM or CAN communication.

As another exemplary embodiment, the signal transmitter 100 may be configured to stop transmission of a signal to the controller 300, select any one of one or more operation patterns (P) stored according to various signals, and transmit the selected operation pattern to the controller 300 using PWM or CAN communication. Meanwhile, the controller 300 may be configured to select any one of one or more image shapes stored according to various signals received from the signal transmitter 100. When the lamp on signal is applied, the controller 300 may be configured to adjust the rotation angle of the LED unit 200 to be a reference state.

According to an example, the controller 300 may be configured to measure a time or an RPM adjusted to adjust the rotation angle of the LED unit 200 to become the reference state, and select the measured time or RPM as one cycle. In addition, the controller 300 may be configured to determine the operation pattern of the one or more LED elements 210 which may implement the selected image shape for each cycle, and calculate the magnitude of the applied voltage applied to the one or more LED elements 210 for each cycle so that the operation pattern may be implemented.

The controller 300 may be configured to transmit the calculated applied voltage for each cycle to the power transmitter. The power transmitter may be configured to apply an applied voltage to the power receiver according to the received applied voltage for each cycle, and the power receiver may be configured to apply the applied voltage to each of the one or more LED elements 210. Accordingly, the image shape selected by the controller 300 is implemented outside the vehicle by the light irradiated to the front of the LED unit 200.

Meanwhile, the driving guider 800 may include a rail having an end portion thereof fixed to the rotary shaft 410 that protrudes from the driver 400 to the outside of the vehicle. One or more LED elements 210 may be fixed to the rails to be listed. The power receiver 700 may be mounted to the rail to be electrically connected to the one or more LED elements 210. Additionally, the power transmitter 600 may be formed along the trajectory of the rail generated when the rotary shaft 410 rotates. The one or more LED elements 210 may be moved along the rail.

As shown in FIG. 10, the power transmitter 600 and the power receiver 700 may contact each other when the rotary shaft 410 rotates. Since the power transmitter 600 and the power receiver 700 contact when the rotary shaft 410 rotates, the applied voltage may be applied from the power transmitter 600 to the one or more LED elements 210.

As shown in FIG. 11, the power transmitter 600 and the power receiver 700 may also be formed to cause electromagnetic induction to be generated between the power receiver 700 and the power transmitter 600 when the rotary shaft 410 rotates. When the rotary shaft 410 rotates, the electromagnetic induction may be generated between the power transmitter 600 and the power receiver 700, to thus apply the applied voltage from the power receiver 700 to the one or more LED elements 210.

Figure 12:
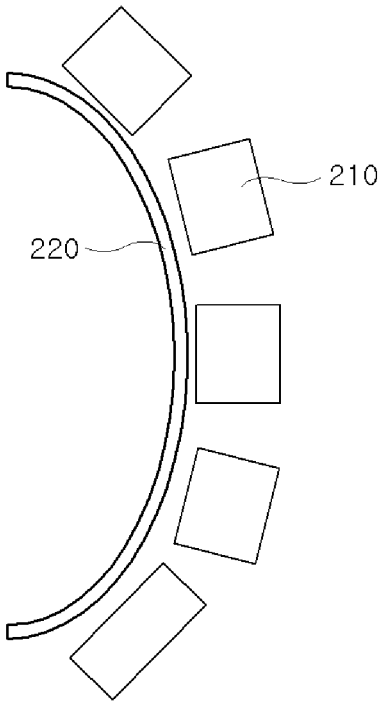
FIGS. 12 to 14 are exemplary diagrams showing an LED unit provided in the vehicle lamp with the rotating light source according to the first exemplary embodiment of the present disclosure of FIG. 1.
Figure 13:
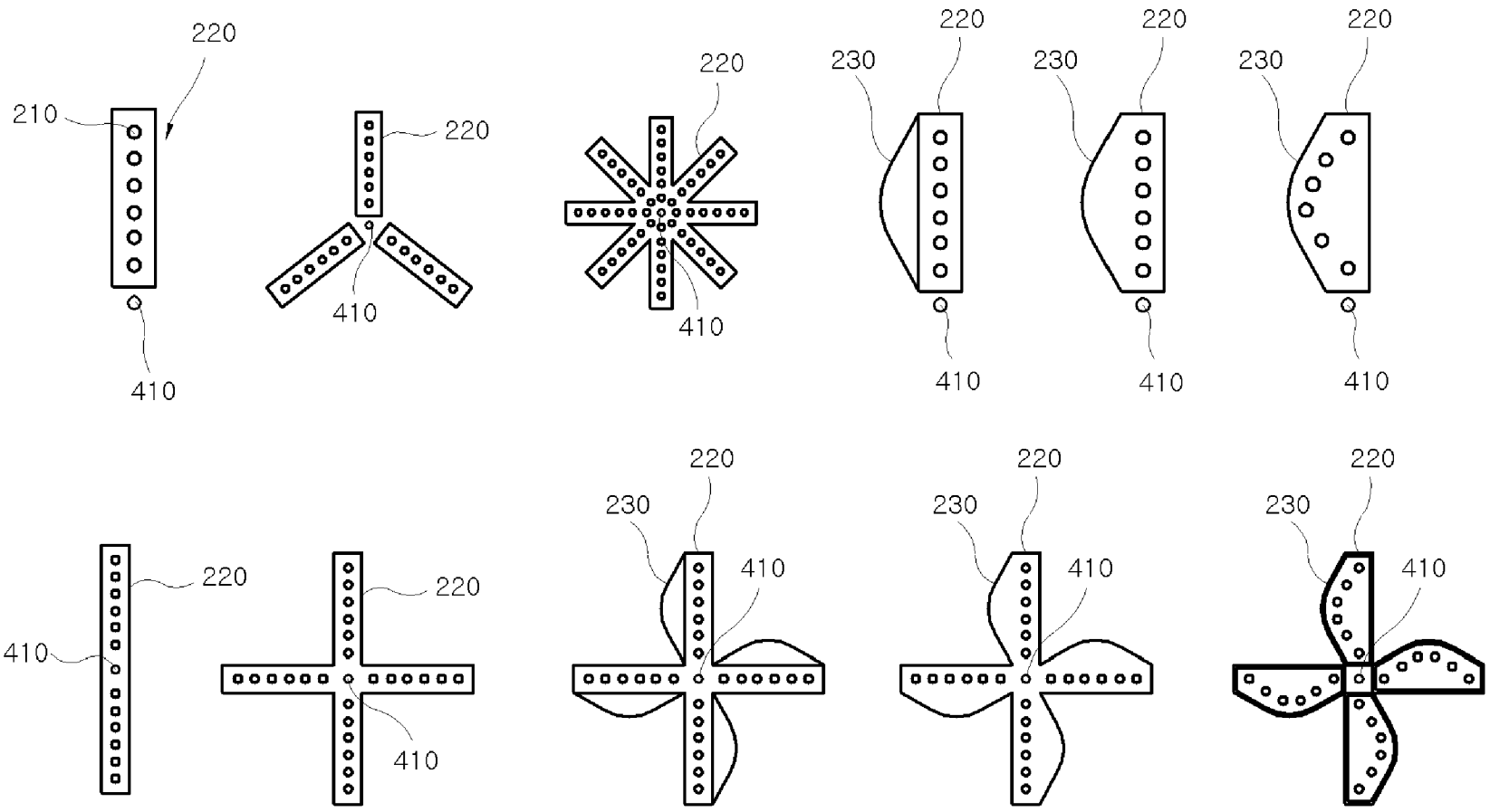
Figure 14:
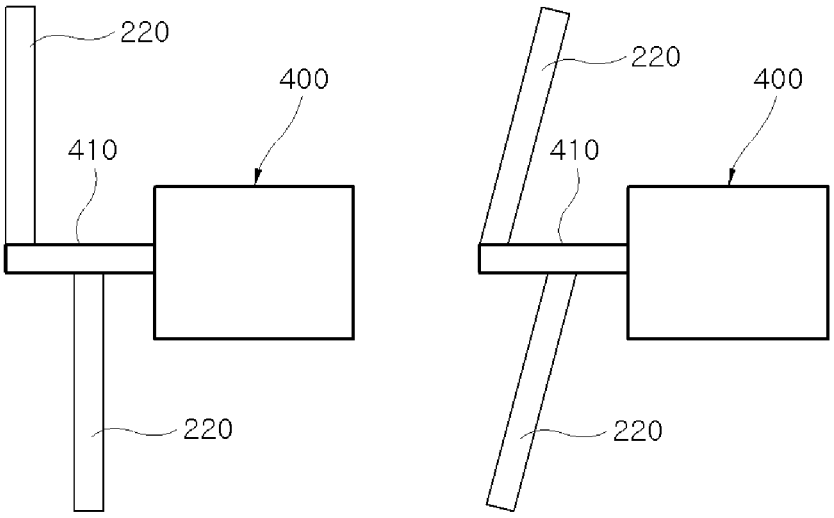

Meanwhile, as shown in FIGS. 12 to 14, the LED unit 200 mounted to the vehicle lamp with the rotating light source according to an exemplary embodiment of the present disclosure may be fixed on the rotary shaft 410 that protrudes from the driver 400 to the front of the vehicle. The LED unit 200 may include one or more rotating plates 220 which form an angle of about 0 degrees to 180 degrees with the rotary shaft 410 forward from the vehicle. According to the light path design, the one or more rotating plates 220 may be curved to have curvature.

Each of the one or more rotating plates 220 may be disposed to be different from each other in a distance from a rotating unit. Since the one or more rotating plates 220 are spaced apart from each other at different distances from the rotating unit, a three-dimensional light source may be implemented. In particular, since the one or more LED elements 210 rotate and generate light, the surface emission generated in front of the vehicle may also form a three-dimensional image.

According to an example, the one or more rotating plates 220 may be formed in a rectangular shape, and may have a first side end portion bonded to the rotary shaft 410. Each of the one or more rotating plates 220 may be mounted with the one or more LED elements 210 in a row from the rotary shaft 410 toward a second side end portion thereof. The one or more LED elements 210 may be mounted at specific intervals different from each other for each rotating plate 220. Since the intervals of the LED elements 210 may be different from each other for each rotating plate 220, the light generated from each of the LED elements 210 has an overlapping region when the one or more rotating plates 220 rotate. Accordingly, the surface emission, which is light in a plane form having no boundary line, may be irradiated in front of the vehicle.

Meanwhile, according to another example, an arc-shaped wing plate 230 may be disposed on the side opposite to the rotation direction of the rotary shaft 410 in the surface of the rotating plate 220. Accordingly, the heat dissipation and moisture control effects of the rotating plate 220 may be improved. In addition, the one or more LED elements 210 may be mounted along the curvature of the wing plate 230. Since the LED element 210 is mounted along the curvature of the wing plate 230, the gap between the LED elements 210 may be widened, and the heat dissipation area may be maximized.

According to the vehicle lamp with the rotating light source according to an exemplary embodiment of the present disclosure configured as described above, as the number of the LED element 210 is reduced, the heat resistance performance of the PCB and the LED element 210 may be improved. In addition, since the LED element 210 may be configured to rotate to emit light, the effects in which a residual image is generated along the rotating path of the LED element 210, and infinite LED elements 210 simultaneously emit light may be obtained. Ultimately, the surface emission having no boundary line may be generated.

In addition, the one or more rotating plates 220 may be provided in the LED unit 200, and the one or more rotating plates 220 may have different distances from the driver 400, thereby implementing a three-dimensional light source. As the LED unit 200 is rotated, the light generated from each LED element 210 may output a soft line light source, to minimize the occurrence of the dark portion on the light irradiation surface in front of the vehicle.

Further, since a soft surface light source may be generated using the phase difference between the LED elements 210, the occurrence of the dark portion may be minimized on the light irradiation surface in front of the vehicle. Since the three-dimensional light source may be generated using the phase difference between the LED elements 210, various optical images may be implemented. In addition, when the color of the light generated by each of the one or more LED elements 210 is adjusted, it may be possible to implement an optical image of various colors.

In addition, only the LED element 210 which emits red color emits light, or the LED element 210 which emits green and red colors may be configured to emit light at the same time, thereby serving as a brake light, a flashing light, or the like. By varying the color temperature of the one or more LED elements 210 mounted to the LED unit 200, respectively, it may be possible to irradiate the light of various color temperatures to the front of the vehicle. Since a large area in front of the vehicle may irradiate the light through a small number of LED elements 210, the cost and the usage voltage are reduced, and the fuel efficiency of the vehicle may be improved.

When the vehicle lamp with the rotating light source according to an exemplary embodiment of the present disclosure may be applied to a headlamp, an optical system may be disposed on the front surface of the LED unit 200, and a shield for implementing downward lighting at operation may be disposed between the LED unit 200 and the optical system. In addition, two or more optical systems may also be disposed on the front surface of the LED unit 200. Particularly, the light emission of the one or more LED elements 210 may also be adjusted to prevent light from reaching a specific optical system.

A reflector rather than the optical system may also be disposed on the front surface of the LED unit 200. In particular, the shield may be disposed at one side of the LED unit 200, and the reflector may be disposed above the LED unit 200 and the shield. In addition, two or more reflectors may also be disposed on the front surface of the LED unit 200. The light emission of the one or more LED elements 210 may be adjusted to prevent light from reaching a specific reflector.

A functional lamp to which the vehicle lamp with the rotating light source according to an exemplary embodiment of the present disclosure is applied may also be embedded in a vehicle front grill. Through the opening of the grill, light of a specific image may be generated. When a wireless key is operated, an icon or a letter expressing welcome may be expressed as a three-dimensional optical image. In particular, the LED unit 200 may also be disposed in a cooling fan located inside the vehicle front grill. In this case, since it is unnecessary to add a separate device, the LED unit may be applied to an existing vehicle.

In the foregoing description, although it has been described that the LED elements 210 are regularly arranged, the one or more LED elements 210 may also be irregularly arranged in the LED unit 200. Particular, to implement the operation pattern (P), the On, Off, and amount of light generation of each LED element 210 may be adjusted according to the RPM and rotation angle of each LED element 210.

In addition, in the foregoing description, it has been described as an example that the vehicle lamp with the rotating light source according to an exemplary embodiment of the present disclosure is applied to the headlamp. However, the vehicle lamp with the rotating light source according to an exemplary embodiment of the present disclosure may be applied to a Rear Combination Lamp (RCL). In particular, when the one or more LED elements 210 are capable of outputting green and red in combination, it is unnecessary to distinguish between a flashing light and a brake light. When the one or more rotating plates 220 are fixed to the rotary shaft 410 to have a phase difference, a three-dimensional optical image (a letter or an icon) may be generated in the Rear Combination Lamp (RCL).

In addition, three rotating plates 220 having a rectangular shape may be mounted at the same angle with respect to the rotary shaft 410, and one rotating plate 220 may be mounted with a green LED element 210, another rotating plate 220 may be mounted with a blue LED element 210, and the other rotating plate 220 may be mounted with a red LED element 210. Particularly, the light of various colors may be irradiated to the front surface of the vehicle by combining green light, blue light, and red light.

In addition, one or more PCBs electrically connected to the LED elements 210 may be mounted for each rotating plate 220. When the one or more PCBs are mounted, a first PCB may be connected to the green LED element, a second PCB may be connected to the blue LED element, and a third PCB may be connected to the red LED element. Accordingly, the LED element 210 may be operated and adjusted for each emission color.

Figure 15:
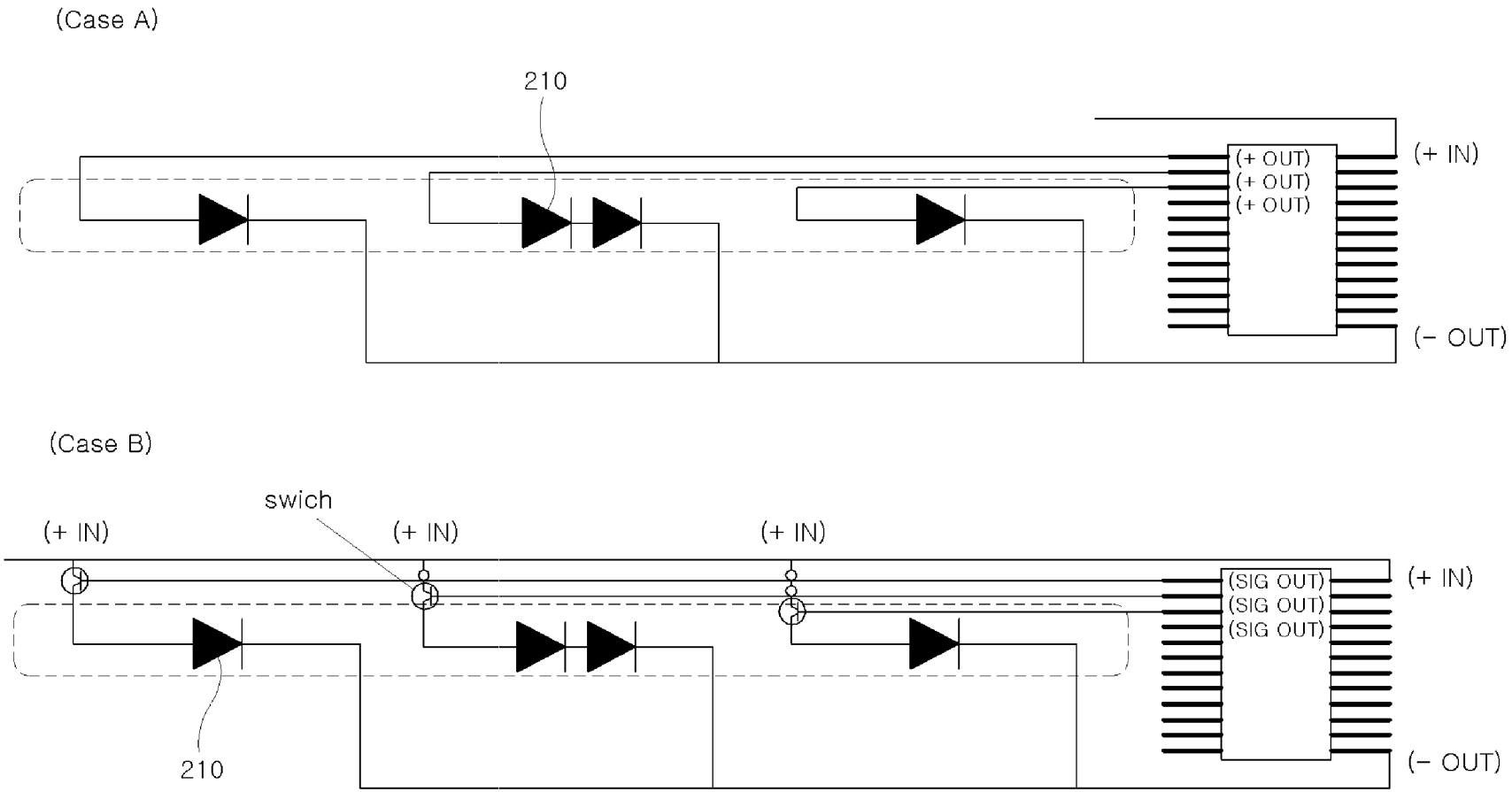
FIG. 15 is a circuit diagram showing a PCB provided on the power transmitter or the power receiver according to an exemplary embodiment of the present disclosure.

Further, as in a case A of FIG. 15, the PCB provided in the power transmitter 600 or the power receiver 700 may be configured to selectively emit the LED element 210 according to the On/Off of the power input from the outside. As in a case B of FIG. 15, the power from the outside may be supplied continuously, but only when a signal is received from the controller 300, a signal sensing switch may also be provided on the PCB provided in the power transmitter 600 or the power receiver 700 to apply power to the LED element 210.

What is claimed is:

1. A vehicle lamp with a rotating light source, comprising:

a signal transmitter configured to receive a signal from one or more sensors mounted within a vehicle;

a light emitting diode (LED) unit having one or more LED elements configured to irradiate light to the outside of the vehicle;

a controller configured to receive the signal from the signal transmitter;

a power transmitter and a power receiver configured to receive an applied voltage to be applied to the one or more LED elements from the controller, and apply the applied voltage to each of the one or more LED elements; and a driver configured to rotate the LED unit, wherein the controller is configured to determine an image shape according to the signal, and calculate the applied voltage to be applied to the one or more LED elements according to the computed image shape, and wherein the LED unit is fixed to a rotary shaft that protrudes from the driver to the outside of the vehicle, the power receiver is mounted to the LED unit to be electrically connected to the one or more LED elements, and the power transmitter, the controller, and the signal transmitter are disposed and fixed to one side of the driver.

2. The vehicle lamp with the rotating light source of claim 1, wherein the signal includes any one or more of an angle of a front vehicle, a front image of the vehicle, and a rear image of the vehicle from the center line of the front and rear of the vehicle, wherein the signal transmitter is configured to receive a lamp AUTO switch operation signal, an upward lighting operation signal, and a revolutions per minute (RPM) of the driver, in addition to the signal, and wherein the controller is configured to select any one of one or more image shapes stored according to various signals received from the signal transmitter.

3. The vehicle lamp with the rotating light source of claim 1, wherein the applied voltage is applied to the one or more LED elements from the power transmitter through a slip ring or a gear disposed between the power transmitter and the power receiver.

4. The vehicle lamp with the rotating light source of claim 1, wherein the applied voltage is applied to the one or more LED elements from the power transmitter by electromagnetic induction generated between the power transmitter and the power receiver, when the LED unit rotates.

5. The vehicle lamp with the rotating light source of claim 4, wherein the power transmitter and the power receiver include a printed circuit board (PCB), and wherein the PCB includes:

two or more pattern surfaces on which a circuit pattern is printed; and an insulating filler disposed between the two or more pattern surfaces, wherein the circuit patterns printed on the two or more pattern surfaces are connected to form a coil shape.

6. The vehicle lamp with the rotating light source of claim 5, wherein the circuit pattern includes:

a first side end portion that protrudes from the lower portion of the pattern surface;

a second side end portion protruded from the upper portion of the pattern surface; and a center portion that connects the first side end portion and the second side end portion and disposed on the pattern surface as a ring shape.

7. The vehicle lamp with the rotating light source of claim 1, further comprising:

an optical system disposed on the front surface of the LED unit, and for inducing light generated by the one or more LED elements to a specific direction.

8. The vehicle lamp with the rotating light source of claim 1, further comprising a reflector and a shield disposed on the front surface of the LED unit, and for inducing light generated by the one or more LED elements to a specific direction.

9. A vehicle lamp with a rotating light source, comprising:

a signal transmitter configured to receive a signal from one or more sensors mounted within a vehicle;

a light emitting diode (LED) unit having one or more LED elements configured to irradiate light to the outside of the vehicle;

a controller configured to receive the signal from the signal transmitter;

a power transmitter and a power receiver configured to receive an applied voltage to be applied to the one or more LED elements from the controller, and apply the applied voltage to each of the one or more LED elements;

a driving guider to which the LED unit is fixed; and a driver configured to move the driving guider, wherein the controller is configured to determine an image shape according to the signal, and calculate the applied voltage to be applied to the one or more LED elements according to the computed image shape, wherein the driving guider includes a rail having an end portion fixed to a rotary shaft that protrudes from the driver to the outside of the vehicle, wherein the one or more LED elements are fixed to the rail;

wherein the power receiver is mounted to the rail to be electrically connected to the one or more LED elements, and wherein the power transmitter is formed along the trajectory of the rail generated when the rotary shaft rotates.

10. The vehicle lamp with the rotating light source of claim 9, wherein when the rotary shaft rotates, the applied voltage is applied to the one or more LED elements from the power transmitter by the contact between the power receiver and the power transmitter.

11. The vehicle lamp with the rotating light source of claim 9, wherein when the rotary shaft rotates, the applied voltage is applied to the one or more LED elements from the power receiver by electromagnetic induction generated between the power receiver and the power transmitter.

* * * * *